US011289225B2

(12) United States Patent
Bermuth

(10) Patent No.: US 11,289,225 B2
(45) Date of Patent: Mar. 29, 2022

(54) RADIATION PROTECTION DEVICE FOR INSPECTION FACILITIES

(71) Applicant: SMITHS HEIMANN GMBH, Wiesbaden (DE)

(72) Inventor: Jörg Bermuth, Rockenberg (DE)

(73) Assignee: SMITHS HEIMANN GMBH, Wiesbaden (DE)

( * ) Notice: Subject to any disclaimer, the term of this patent is extended or adjusted under 35 U.S.C. 154(b) by 10 days.

(21) Appl. No.: 16/632,732

(22) PCT Filed: Jul. 20, 2018

(86) PCT No.: PCT/EP2018/069754
§ 371 (c)(1),
(2) Date: Mar. 16, 2020

(87) PCT Pub. No.: WO2019/016365
PCT Pub. Date: Jan. 24, 2019

(65) Prior Publication Data

US 2021/0151212 A1 May 20, 2021
US 2022/0051826 A9 Feb. 17, 2022

(30) Foreign Application Priority Data

Jul. 21, 2017 (DE) ..... 10 2017 116 551.7

(51) Int. Cl.
*G21F 3/00* (2006.01)
*G21F 1/08* (2006.01)

(52) U.S. Cl.
CPC ..... *G21F 3/00* (2013.01); *G21F 1/085* (2013.01)

(58) Field of Classification Search
CPC ..... G21F 3/00; G21F 1/085
(Continued)

(56) References Cited

U.S. PATENT DOCUMENTS 7,050,536 B1 5/2006 Fenkart et al.
9,255,897 B1 * 2/2016 Conway ..... G01V 5/0008
(Continued)

FOREIGN PATENT DOCUMENTS

CN 101382506 A 3/2009
CN 102540269 A 7/2012
(Continued)

OTHER PUBLICATIONS

International Search Report and Written Opinion for PCT/EP2018/069754, dated Oct. 12, 2018. 13 pages.
(Continued)

*Primary Examiner* — Nicole M Ippolito
(74) *Attorney, Agent, or Firm* — Armstrong Teasdale LLP

(57) ABSTRACT

A radiation protection device for an opening for inspection objects on a radiation tunnel is provided. The radiation protection device is formed from a plurality of radiation protection curtains arranged one behind the other at a distance in a transport direction, wherein a first radiation protection curtain includes a first shielding radiation protection curtain section covering only a first area of the opening and second shielding radiation protection curtain sections of at least one second radiation protection curtain arranged behind the first radiation protection curtain in the transport direction cover the area of the opening not covered by the first radiation protection curtain.

20 Claims, 2 Drawing Sheets

(58) Field of Classification Search
USPC ..... 250/505.1, 506.1, 515.1, 516.1, 517.1, 250/518.1, 519.1
See application file for complete search history.

(56) References Cited

U.S. PATENT DOCUMENTS

| | | | | |
|---|---|---|---|---|
| 2005/0185757 | A1 | 8/2005 | Kreese et al. | |
| 2015/0262720 | A1 | 9/2015 | Weed | |
| 2016/0372223 | A1* | 12/2016 | Splinter | G21F 3/00 |

FOREIGN PATENT DOCUMENTS

| | | | |
|---|---|---|---|
| CN | 204436228 | U | 7/2015 |
| DE | 10131407 | A1 | 1/2003 |
| JP | 2015059813 | A | 3/2015 |

OTHER PUBLICATIONS

German Search Report for 102017116551.7, dated Jul. 18, 2018. 2 pages.

* cited by examiner

RADIATION PROTECTION DEVICE FOR INSPECTION FACILITIES

The present disclosure relates in general to protection against ionizing radiation, such as X-rays produced by X-ray tubes. In particular, the disclosure concerns a radiation protection device, in particular a radiation protection curtain with novel radiation protection elements, for example for use at a radiation tunnel of an X-ray inspection apparatus.

BACKGROUND

The non-destructive inspection of objects by means of X-ray inspection apparatuses is known, for example, from material testing, quality control in production, but also for security checks of objects at checkpoints at the access to security areas or vulnerable areas.

With known X-ray inspection apparatuses, a radiation protection curtain is usually located at the entrance of a radiation tunnel. If an object to be inspected (inspection object), for example a piece of baggage, is moved into or out of a radiation area of the inspection apparatus through the radiation protection curtain, the radiation protection curtain prevents ionizing radiation from escaping from the radiation tunnel. Accordingly, a radiation shielding curtain may be arranged at any open end of the radiation tunnel, i.e., for example, at a first end for inward transfer and, if necessary, at a second end if the radiation tunnel is open at the rear end for outward transfer of the inspection objects.

A radiation protection curtain usually consists of several radiation protection elements in the form of tabs, strips or lamellae, which are attached directly next to each other and transverse to the direction of transport of objects to be inspected by the X-ray inspection apparatus and which are suspended from the X-ray inspection apparatus, and which consist of a material, for example lead, which sufficiently attenuates ionizing radiation. In order to achieve sufficient attenuation, the radiation protection elements have a minimum material thickness and, as a result, a high weight. During operation, the radiation protection elements obstruct the passage of especially small and/or light inspection objects ("problem objects"). Especially smaller inspection objects can get caught in the radiation protection curtain. As a result, inspection objects can accumulate at the radiation protection curtain. Accumulated inspection objects are finally conveyed into the radiation tunnel in a butt joint as a compound. Especially with automatic inspection apparatuses, such as in baggage handling systems, the problem arises of reliably distinguishing the individual inspection objects in such a compound. A similar problem arises when using trays in which smaller inspection objects are inserted. A tray can be moved on the conveyor belt by the resistance of a radiation protection curtain. In X-ray inspection apparatuses that use different X-ray principles, such as computed tomography (CT) and line-by-line fluoroscopy (line scanner), problems can arise in the correlation between the transmission information from the line scanner and the CT due to the positional change of the tray on the conveyor belt.

DE 101 31 407 A1 proposes to arrange several light radiation protection curtains at certain distances one behind the other instead of a single radiation protection curtain consisting of several flexible, heavy lead taps arranged next to each other. The material thickness of the individual lead taps is dimensioned in such a way that in total the required minimum thickness is ensured. As a result of the lower weight of the individual lead taps, the frictional forces occurring during operation between an inspection object and the individual radiation protection curtain are lower in comparison to a single and therefore heavier radiation protection curtain, so that the above-mentioned problems can be avoided as far as possible.

FIG. 1 shows the well-known X-ray inspection apparatus 1 in a lateral cross-section. The X-ray inspection apparatus 1 has four lead curtains 3*a*-3*d*, which are arranged in pairs and at a distance behind each other in a radiation tunnel 2 of the X-ray inspection apparatus 1. The two front functionally interacting lead curtains 3*a*, 3*b* are arranged inside the radiation tunnel 2 in front of a radiation area 4, the two rear functionally interacting lead curtains 3*c*, 3*d* are arranged behind this radiation area 4. In the radiation area 4 at least one radiation source 5 and at least one detector arrangement 6 aligned therewith are arranged. Sliding belt conveyors 8 serve to transport a piece of baggage 7 as an inspection object into and through the radiation tunnel 2. The implementation of the radiation protection device known from DE 101 31 407 A1 requires an arrangement of the front curtains 3*a*, 3*b* or the rear curtains 3*c*, 3*d* one behind the other at certain minimum distances. However, this leads to a corresponding extension of the radiation tunnel 2 of the X-ray inspection apparatus 1.

BRIEF DESCRIPTION

The present disclosure provides an improved radiation protection device, in particular for an X-ray inspection apparatus, in which an obstruction of the inspection objects passing through the radiation protection device can be avoided while keeping the length of the radiation tunnel of the X-ray inspection apparatus short.

Features and details which are described in connection with the radiation protection device and the radiation protection element according to the disclosure are also valid in connection with the inspection apparatus according to the disclosure and vice versa. Therefore, mutual reference is made with regard to the disclosure of the individual aspects.

A first aspect of the present disclosure concerns a radiation protection device for shielding ionizing radiation at an opening for inspection objects of a radiation tunnel of an inspection apparatus. The opening may be used for inward transfer and/or outward transfer of the inspection objects into and/or out of the radiation tunnel. The generic radiation protection device is formed by several radiation protection curtains arranged one behind the other at a distance in a transport direction of the inspection objects in the radiation tunnel.

According to the disclosure, the radiation protection device has a first radiation protection curtain with a first shielding radiation protection curtain section. The first shielding radiation protection curtain section is dimensioned so that it only covers a first area of the opening. This allows inspection objects to be transported under the first radiation protection curtain up to a height predetermined by the length of the first shielding radiation protection curtain section without touching the first radiation protection curtain.

According to the disclosure, second shielding radiation protection curtain sections of at least one second radiation protection curtain arranged behind the first radiation protection curtain in the transport direction of the inspection objects cover the area of the opening not covered by the first radiation protection curtain. That is there is at least one second radiation protection curtain which is dimensioned such that its second shielding radiation protection curtain section shields the area of the opening of the radiation tunnel which is not shielded by the first radiation protection curtain.

In other words, the radiation protection device according to the disclosure can basically have several second radiation protection curtains of the described type one behind the other, which are dimensioned in total in such a way that the several second shielding radiation protection curtain sections each shield an area of the opening of the radiation tunnel which has not yet been shielded by the first radiation protection curtain and possibly preceding second radiation protection curtains.

The length of the last second radiation protection curtain of the radiation protection device may be dimensioned with regard to the height of the relevant problem objects. The last second radiation protection curtain is the one which finally covers the opening of the radiation tunnel. This is the lower edge of the last second radiation protection curtain is located directly at the transport level through the radiation tunnel. As described at the beginning, problem objects are those objects that, due to their size and weight, get caught on the radiation protection curtains of the state of the art. For example, a particular height may be the height of transport trays that are used as a standard container for the inspection of smaller objects as containers. Alternatively, an average height of light and flat packages or rolls can be used.

"Shielding" in the context of the radiation protection device of the disclosure means shielding for a specific type of radiation, for example ionizing radiation such as X-rays. In this context, "shielding" does not necessarily mean 100% impermeable to the radiation in question, but should be understood in the sense of "attenuating". This means that a shielding radiation curtain section is set up in such a way that only a predetermined proportion of the radiation is passing through it.

The radiation tunnel of an inspection apparatus is basically an ionizing radiation shielding tube into which a transport system can introduce inspection objects at the opening of a first open end in the direction of transport. The opening at the first open end can serve as both entrance and exit of the radiation tunnel. Alternatively, the opening at the first open end of the radiation tunnel can be the entrance to the radiation tunnel and a second opening at a second open end can serve as the exit of the radiation tunnel. In this configuration, inspection objects can be conveyed in the transport direction through the radiation tunnel from the entrance to the exit.

The radiation tunnel may have a radiation section in which inspection objects can be non-destructively X-rayed by means of ionizing radiation in a manner known per se. For this purpose, at least one radiation source, e.g. an X-ray tube, and at least one detector arrangement aligned with the radiation emitted by the radiation source in a directed manner can be arranged in the radiation section.

The radiation protection device may be a passable cover of the opening at the radiation tunnel of the inspection apparatus. The passable, i.e. passable by an inspection object, radiation protection device is used for the inward or outward transfer of inspection objects into or out of the radiation tunnel. For example, a radiation protection curtain can be formed by individual radiation protection elements so that an inspection object can make its way through the radiation protection curtain by displacing individual radiation protection elements. The cover thus serves to shield the radiation tunnel to the outside by preventing ionizing radiation in an impermissible dose from escaping from the radiation tunnel through the opening.

The first radiation protection curtain may cover starting from an upper edge, opposite to a transport plane defined by a transport system for the inspection objects, of the opening with the first shielding radiation protection curtain section, which has a first length. According to the disclosure, the first length is only a fraction of the clear height of the opening.

The shielding radiation protection curtain sections of two curtains following each other in the transport direction through the radiation tunnel may overlap in the longitudinal direction by an overlap length with respect to the transport direction.

The overlapping length ΔL of the overlap of two consecutive radiation protection curtains may be determined as ΔL greater than or equal to the distance D between these consecutive radiation protection curtains.

Two consecutive radiation protection curtains may be arranged at a predetermined distance from each other in the transport direction through the radiation tunnel.

The predetermined distance may be approximately the length of the overlapping section of the shielding radiation protection curtain sections of two consecutive radiation protection curtains.

The distance D may be greater than or equal to a minimum distance $D_{min}$ of two consecutive radiation protection curtains, which is determined as $$D_{min}=\sqrt{2*L1*\Delta L-\Delta L^2},$$

where L1 is the total length of the shielding radiation curtain section of the previous radiation curtain and ΔL is the length of an overlap of the shielding radiation protection sections of the two consecutive radiation protection curtains. This dimensioning is based on the assumption that if the preceding radiation protection curtain swings as far as the following radiation protection curtain, the shielding radiation protection sections should just not overlap; it is assumed that the preceding radiation protection curtain swings in a straight line, i.e. does not bend significantly.

The distance D may be less than or equal to a maximum distance $D_{max}$ of two consecutive radiation protection curtains, which is determined as $$D_{max}=(\Delta L*G)/(LH-L2),$$

where L2 is the length of the shielding radiation protection curtain section of the following radiation protection curtain, G is the distance of the following radiation protection curtain to the plane of the radiation fan (e.g. X-ray fan) generated by a radiation generator, ΔL is the length of an overlap of the shielding radiation protection sections of the two consecutive radiation protection curtains, and LH is the clear height of the opening of the radiation tunnel. This dimensioning is based on the assumption that scattered radiation from the highest point of the tunnel should not directly pass the preceding radiation protection curtain.

A second radiation protection curtain may have at least the second shielding radiation protection curtain section and a non-shielding support section.

In some embodiments, the non-shielding support section may be formed by a support material, for example a film or fabric or the like. The support material may have a lower weight per unit length compared to the material of the shielding radiation shielding curtain section. The support material may have a higher flexibility compared to the material of the shielding radiation shielding curtain section, i.e. a lower bending resistance moment W.

The support material may be applied to at least one side of the shielding radiation curtain section and extends beyond one end of the shielding radiation curtain section to form the support section.

The support material can also be applied to both sides of the shielding radiation protection curtain section and continue at one end of the shielding radiation protection curtain section to form the support section. The two layers of support material can sandwich the shielding radiation shielding curtain section.

The support material may be made of a material with a lower coefficient of friction than the surface of the shielding radiation curtain sections so that the support material cannot ad-here to an inspection object and/or an adjacent shielding radiation curtain section. This may be done if the support material is applied to both sides of the shielding radiation shielding curtain section.

The support material may consist of a material which has a sufficiently high torsional stiffness (shear modulus x torsional moment of inertia) so that it does not twist during operation.

For example, the support material can be a film made of poly(p-phenylene terephthalamide) (PPTA), poly(m-phenylene isophthalamide) (PMPI), thermoplastic elastomer (TPC-ET), vulcanized plastic with filled plastic (e.g. Trilliant from Poly One) or similar.

The support section may be connected to the second shielding radiation curtain section by at least one of the following joining techniques from the group consisting of gluing, clamping, riveting, and sewing.

In a first and/or second shielding radiation curtain section, at least the core may contain or consist of a material with a high atomic number, preferably at least one of the following materials: pure lead, lead oxide, tin, tin oxide, lead vinyl, lead rubber, barium, samarium, tungsten, or a mixture of some or all of these materials. The core may have a material thickness corresponding to a predetermined lead equivalent.

The first or the at least one second radiation curtain may be formed by individual radiation protection elements. The radiation protection elements may each have a strip shape. The strip length may be greater than the strip width. The strip thickness (material thickness) may be considerably smaller than the strip width.

The strip width may be about 10 to 120 mm, more particularly 80 to 100 mm, and even more particularly 90 mm. The strip thickness in the transport direction of a shielding radiation protection curtain section may be about 2.5 mm if lead is used as material (lead equivalent value).

A second aspect of the present disclosure concerns a radiation protection element for a radiation protection device, in particular for a radiation protection device according to the first aspect of the disclosure. A radiation protection element according to the disclosure has in its longitudinal direction a shielding section and a non-shielding support section. The non-shielding support section is dimensioned in such a way that, when the radiation protection element is arranged in the radiation protection device according to the disclosure, it runs in the area of the opening to be covered by the radiation protection device and supports the shielding section. The shielding section, in turn, runs completely in the area of the opening to be covered by the radiation protection device when the radiation protection element is properly arranged on the radiation protection device.

In one implementation, the non-shielding support section may be formed from a support material, for example, a foil, fabric or similar. The support material may have a lower weight per unit length compared to the material of the shielding section.

The support material may have a higher flexibility compared to the material of the shielding section, i.e. lower resistance bending moment W.

The support material is applied to at least one side of the shielding section and continues at one end of the shielding section to form the support section.

The support material may be applied to both sides of the shielding section and continues at one end of the shielding section to form the support section. This is two layers of support material surround the shielding section like a sandwich.

The support material may consist of a material which has a lower coefficient of friction than the surface of the shielding sections so that the support material cannot adhere to an inspection object and/or an adjacent shielding section. This may be done if the support material is applied to both sides of the shielding section.

The support material may consist of a material which has a sufficiently high stiffness (shear modulus x torsional moment of inertia) so that it does not twist during operation.

For example, the support material can be made of poly (p-phenylene terephthalamide) (PPTA), poly(m-phenylene isophthalamide) (PMPI), thermoplastic elastomer (TPC-ET), vulcanized plastic with filled plastic (e.g. Trilliant from Poly One) or similar.

The support section may be connected to the shielding section by means of at least one of the following joining techniques from the group consisting of: gluing, clamping, riveting and sewing.

In a shielding section, at least the core of a material may have a high atomic number, for example at least one of the following materials or consisting of: pure lead, lead oxide, tin, tin oxide, lead vinyl, lead rubber, barium, samarium, tungsten, or a mixture of some or all of these materials.

A third aspect of the present disclosure concerns an inspection apparatus with at least one radiation protection device according to the first aspect of the disclosure. The radiation protection device may be mounted at an opening of a radiation tunnel of the inspection installation. The opening may be an entrance of the radiation tunnel or an exit of the radiation tunnel.

Radiation shielding elements of the first curtain may be attached to the inspection apparatus at one end of the first shielding radiation curtain section by at least one joining technique from the group consisting of: screwing, clamping and riveting.

The radiation protection elements of the second curtains may be fastened at one end of the support section to the inspection apparatus by at least one joining technique from the group consisting of screwing, clamping and riveting.

A fourth aspect of the present disclosure relates to a method for retrofitting a radiation protection device on an X-ray inspection apparatus, wherein an existing radiation protection device is replaced by a radiation protection device according to the first aspect of the disclosure.

In all design examples, a radiation protection element in its shielding area, i.e. in the area of its shielding section, has the ionizing radiation shielding material in a material thickness corresponding to a predetermined lead equivalent value. The required minimum thickness or material thickness is initially dependent on the intensity of the radiation source to be shielded and the associated radiation values. Legal regulations thus stipulate a maximum permissible radiation value, for example of an X-ray inspection apparatus, from which the necessary shielding of such a apparatus can be determined directly. A number known as the lead equivalent value is used to describe the shielding. The higher the lead equivalent value, the lower the intensity of the ionizing radiation emitted on the side of the radiation protection element facing away from the radiation source.

In an inspection apparatus with one or more radiation protection devices according to the disclosure, particularly smaller inspection objects do not get caught on a radiation protection curtain as often. This prevents jams from inspection objects on the radiation protection device. This avoids the problem associated with such congestions, i.e. that inspection objects that have been accumulated and thus conveyed through the radiation tunnel as a compound are no longer recognized as separate objects, especially during automated inspections, such as in baggage handling systems.

The disclosure also reduces the problem of small, light objects or round objects (e.g. rolls) as well as light trays which can be moved on the conveyor belt by the resistance of a conventional radiation protection curtain and thus, for example, in X-ray inspection apparatuses which combine different X-ray principles for improved inspection, such as computed tomography (CT) and line-by-line fluoroscopy (line scanner) to a poor assignability between the transmission information of the line scanner and the CT.

Up to now, the same effect—if at all—could only be achieved at the expense of the tunnel length by using several lighter curtains—as proposed in DE 101 31 407 A1, for example.

BRIEF DESCRIPTION OF THE DRAWINGS

Further advantages, features and details of the disclosure result from the following description, in which embodiments of the disclosure are described in detail by reference to the drawings. The features mentioned above and the features further elaborated here may each be used individually or in combination with each other. Functionally similar or identical parts or components are partly provided with the same reference signs. The terms "left", "right", "top" and "bottom" used in the description of the design examples refer to the drawings in an alignment with normally legible figure designation or normally legible reference signs. The embodiments shown and described are not to be understood as exhaustive but are of an exemplary nature to explain the disclosure. The detailed description is intended to provide information for the skilled person. Therefore, known structures and processes are not shown or explained in detail in the description in order not to make the understanding of the present description difficult.

DETAILED DESCRIPTION

Figure 2:
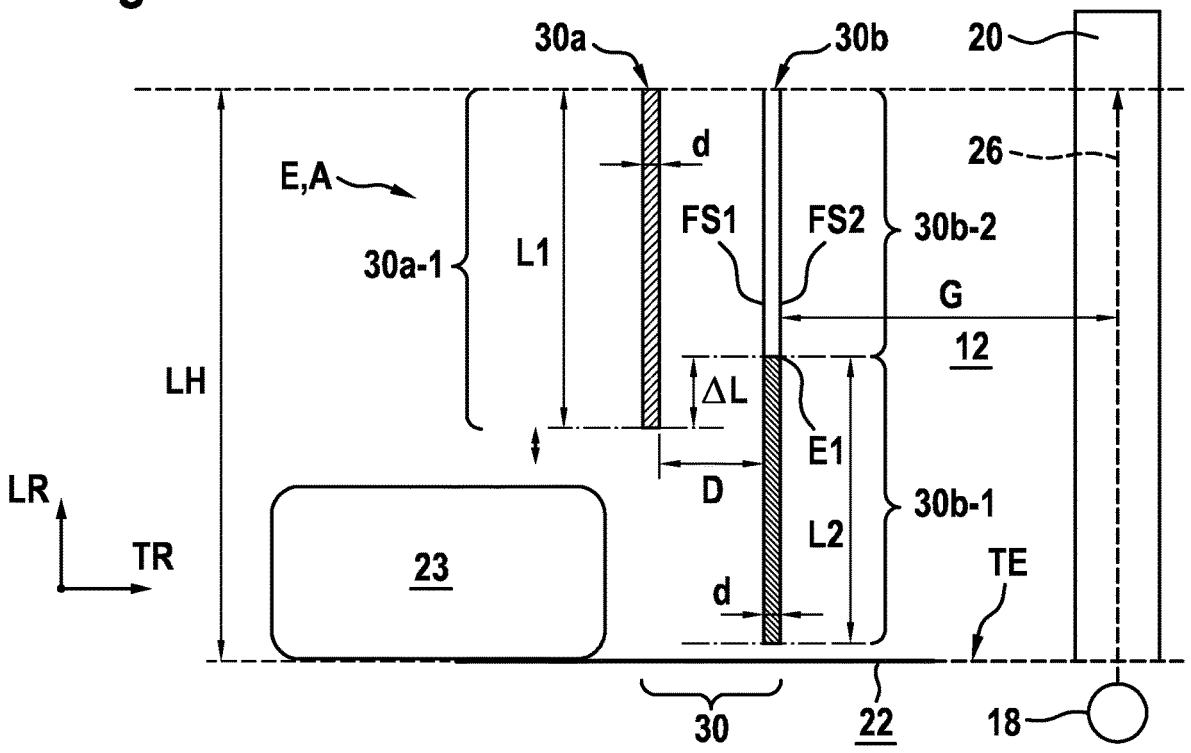
FIG. 2 shows a lateral cross-section of an example embodiment of a radiation protection device according to the disclosure to illustrate the principle.

FIG. 2 shows a lateral cross-section of an example embodiment of a radiation protection device according to the disclosure to illustrate the principle. A radiation protection device 30 is installed at an opening E, A for inspection objects 23 at a radiation tunnel 12 of an inspection apparatus. The radiation protection device 30 consists of several radiation protection curtains 30*a*, 30*b* arranged one behind the other at a distance D in a transport direction TR of the radiation tunnel 12. In the example shown, the radiation protection device 30 consists in total of two radiation protection curtains 30*a*, 30*b*, a first radiation protection curtain 30*a* and a second radiation protection curtain 30*b*.

The first radiation protection curtain 30*a* has a first shielding radiation protection curtain section 30*a*-1, which is dimensioned so that only a first area of the opening E, A is covered. The second shielding radiation protection curtain section 30*b*-1 of one second radiation protection curtain 30*b* arranged behind the first radiation protection curtain 30*a* in transport direction TR is dimensioned in such a way that it covers the area of the opening E, A not covered by the first radiation protection curtain 30*a*.

The radiation protection device 30 is a cover of the opening E, A at the radiation tunnel 12 that can be passed by inspection objects. Thus, the inspection object 23 can pass through the radiation protection device and can be transferred into or out of the radiation tunnel 12. The cover serves to shield the radiation tunnel 12 to the outside by preventing ionizing radiation in an impermissible dose from escaping from the radiation tunnel 12 through the opening E, A.

FIG. 2 shows that the first radiation curtain 30*a* covers the opening E, A with the first shielding radiation curtain section 30*a*-1 over a first length L1 starting from the upper edge of the opening E, A opposite to a transport level TE defined by a transport system 20, e.g. a conveyor belt. The first length L1 represents only a part of the clearance height LH of the opening E, A. This is the first radiation protection curtain 30*a* cannot completely shield the opening E, A alone.

The two shielding radiation protection curtain sections 30*a*-1 and 30*b*-1 of the two radiation protection curtains 30*a* and 30*b*, which follow each other in the transport direction TR through the radiation tunnel 12, overlap or overlay in longitudinal direction LR by an overlapping length ΔL with respect to the transport direction TR. The overlapping length ΔL of the overlap is essentially determined as at least as large as the distance D between the radiation protection curtains under consideration, i.e. ΔL greater than or equal to D.

The two consecutive radiation protection curtains 30*a* and 30*b* are arranged at the predetermined distance D to each other in the transport direction TR through the radiation tunnel 12. The distance D is approximately the length ΔL of the overlapping section of the shielding radiation protection curtain sections 30*a*-1 and 30*b*-1.

The minimum distance $D_{min}$ of the two consecutive curtains 30*a*, 30*b* is greater than or equal to $$D_{min}=\sqrt{2*L1*\Delta L-\Delta L^2},$$

where L1 is the total length of the shielding radiation protection curtain section 30*a*-1 of the preceding radiation protection curtain 30*a* and ΔL is the length of the overlap of the radiation protection sections 30*a*-1, 30*b*-1 of the two successive radiation protection curtains 30*a*, 30*b*

The maximum distance $D_{max}$ of the two consecutive radiation protection curtains 30*a*, 3*b* is less than or equal to $$D_{max}=(\Delta L*G)/(LH-L2),$$

where L2 is the length of the shielding radiation protection curtain section of the following radiation protection curtain 30*b*, G is the distance of the following radiation protection curtain 30*b* to the radiation fan 26 generated by the radiation generator 18, ΔL is the length of the overlap of the shielding radiation protection sections 30*a*-1, 30*b*-1 of the two consecutive radiation protection curtains 30*a*, 30*b* and LH is the clearance height of the opening E, A of the radiation tunnel 12.

The second radiation protection curtain 30*b* consists of the second shielding radiation protection curtain section 30*b*-1 and a non-shielding support section 30*b*-2. In the example shown, the non-shielding support section 30*b*-2 is formed from a foil as support material. Other materials, such as a fabric or a woven fabric, can also be used as support materials. In the example embodiment, the support material is a foil.

Compared to the material of the shielding radiation protection curtain section 30*b*-1, the foil as support material has a lower weight per unit length and, compared to the material of the shielding radiation protection curtain section 30*b*-1, a higher flexibility, i.e. a lower bending resistance moment W.

To connect the radiation protection curtain section 30*b*-1 with the foil, the foil is applied to both sides of the shielding radiation protection curtain section 30*b*-1 and extends one end of the shielding radiation protection curtain section 30*b*-1, which is located at the top with respect to the transport plane TE, to form the support section 30*b*-2. This is two layers of foil FS1, FS2 sandwich the shielding radiation protection curtain section 30*b*-1.

The foils FS1, FS2 consist of poly(p-phenylene terephthalamide) (PPTA), poly(m-phenylene isophthalamide) (PMPI), thermoplastic elastomer (TPC-ET) or similar, e.g. made of Kevlar or Hytrel, all materials which have a lower coefficient of friction than the surface of the shielding radiation protection curtain sections 30*a*-1, 30*b*-1. Thereby it is ensured that the foils FS1, FS2 do not adhere to an inspection object 23 and/or an adjacent shielding radiation protection curtain section 30*b*-1. In addition, the foils FS1, FS2 have a sufficiently high stiffness so that they do not twist during operation.

In the example, the support section 30*b*-2 is connected to the second shielding radiation protection curtain section 30*b*-1 by the sandwich-like bonding, but can alternatively or additionally also be connected by riveting or the like.

The radiation protection curtains 30*a* and 30*b* shown in FIG. 2 in a lateral cross-sectional view consist of individual radiation protection elements arranged next to each other essentially transverse to the transport direction TR. These radiation protection elements, which are not shown in detail, have the form of tabs, lamellas or strips. This is the length of a radiation protection element is greater than its width and the thickness or thickness is considerably smaller than the width. The length is defined in the longitudinal direction LR. The width is essentially perpendicular to the direction of transport TR. The thickness d (or thickness) is defined essentially in the direction of transport TR. The width may be about 90 mm, but can also be up to a maximum of 120 mm and a minimum of 10 mm. The thickness d in transport direction TR may be typically about 2.5 mm, this value being based on lead as shielding material, i.e. if a different material or mixture of materials is used, the thickness d must be adjusted accordingly. In other words, the thickness d may be set so that it corresponds to a predetermined lead equivalent value which is required to achieve the desired shielding of ionizing radiation. The shielding sections of radiation protection elements contain or consist at least in their core of at least one material suitable for shielding ionizing radiation, such as pure lead (powder), lead oxide, tin, tin oxide, lead vinyl, lead rubber, barium and samarium, tungsten or a mixture of some or all of these materials.

A radiation shielding element for the second radiation curtain 30*b* of the radiation protection device 30 shown in the Figures has in its longitudinal direction LR the shielding section 30*b*-1 and the non-shielding support section 30*b*-2 The non-shielding support section 30*b*-2 is dimensioned so that, when the radiation shielding element is arranged as intended to form the radiation protection device 30, it runs in the area of the opening E, A to be covered by the radiation protection device 30 and supports the shielding section 30*b*-1. The shielding section 30*b*-1, in turn, runs completely in the area of the opening E, A still total to be covered by the radiation protection device 30 when the radiation protection element is arranged as specified.

As explained above in connection with the first and second radiation protection curtains 30*a*, 30*b*, the non-shielding support section 30*b*-2 in the design example is made of a foil.

Firstly, the material and/or dimensions of the foil are selected so that the support section has a lower weight per unit length compared to the shielding section 30*b*-1, thus the radiation shielding element is lighter compared to a conventional radiation shielding element which is dimensioned to cover the entire opening E, A.

Alternatively, or additionally, the material and/or dimensions of the foil are selected so that the support section 30*b*-2 has a higher flexibility compared to the shielding section 30*b*-1.

In the version shown in FIG. 2, one foil FS1 and one foil FS2 are applied to each side of the shielding section 30*b*-1 in transport direction TR. Each of the foils FS1, FS2 continues at one end E1 of the shielding section 30*b*-1 to form the support section 30*b*-2. In other words, the two foils FS1 and FS2 sandwich the shielding section 30*b*-1 to protect the shielding section 30*b*-1.

It should be noted that only one of the foils FS1, FS2 can be applied or attached to only one of the two sides of the shielding section 30*b*-1. This one film FS1 or FS2 would then also continue at one end E1 of the shielding section 30*b*-1 to form the support section 30*b*-2 at the required length.

As noted above, the foils FS1 and FS2 are made of a material that has a lower coefficient of friction than the surface of the shielding sections 30*a*-1, 30*b*-1, so that the foil does not adhere to an inspection object and/or an adjacent shielding section 30*a*-1 or 30*b*-1.

In order to prevent the foil(s) FS1, FS2 from twisting during operation, the foil(s) is (are) made of a material and/or designed with a thickness so that a sufficiently high stiffness is achieved. For example, the film is made of poly(p-phenylene terephthalamide) (PPTA), poly(m-phenylene isophthalamide) (PMPI), thermoplastic elastomer (TPC-ET) or similar.

It should be noted that the support section 30*b*-2 can also be made of another material.

The support section 30*b*-2 is connected to the shielding section 30*b*-1 at the end E1. In the implementation shown, the connection is ensured by the fact that the two foils FS1 and FS2 sandwich the shielding section 30*b*-1 and thus create a firm connection. However, it is possible to make the connection additionally, or alternatively, especially with other materials for the support section 30*b*-2, for example by using an adhesive and/or by clamping and/or by riveting.

The shielding section 30*a*-1 of the radiation protection element has at least one core which consists of or at least contains a material which dampens ionizing radiation. Such materials are for example pure lead, lead oxide, tin, tin oxide, lead vinyl, lead rubber, barium, samarium.

Figure 3:
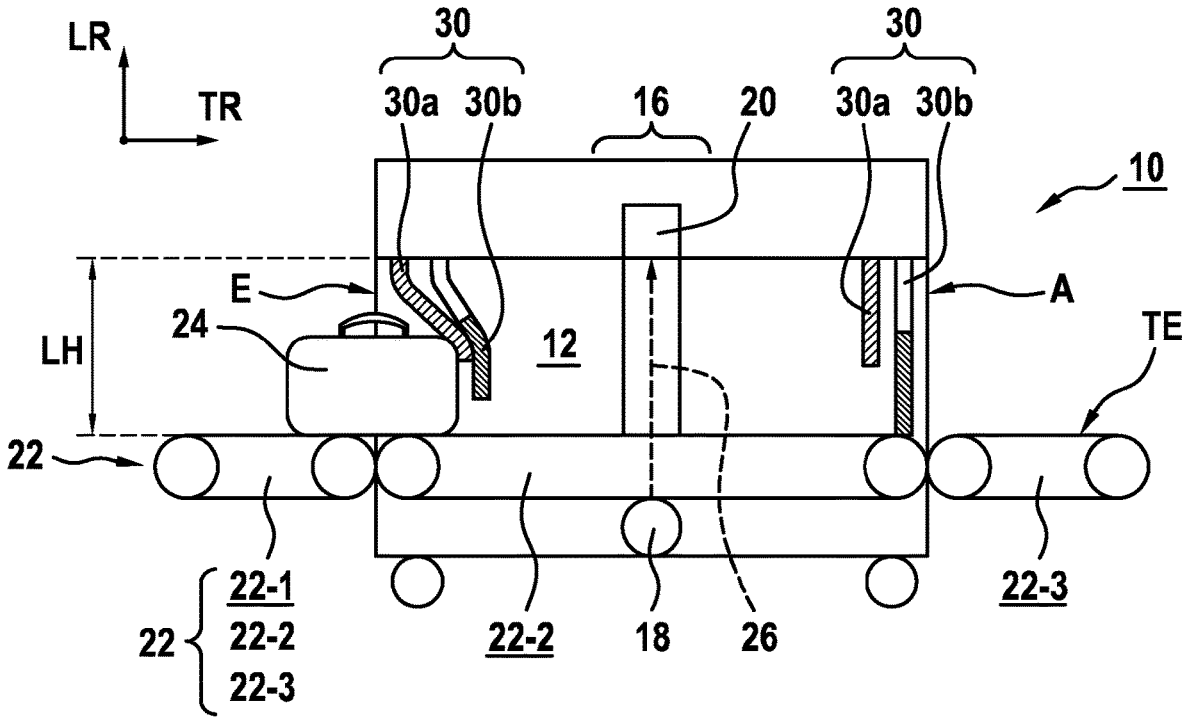
FIG. 3 shows a first use case of an example embodiment of a radiation protection device according to the disclosure in a lateral sectional view and an inspection object with a height such that the inspection object must displace the first radiation protection curtain in order to pass through it.

FIG. 3 shows a first use case of an example embodiment of a radiation protection device 30 according to the disclosure in a lateral sectional view and an inspection object 24 with a height such that the inspection object 24 must displace the first radiation protection curtain 30*a* in order to pass it.

Figure 4:
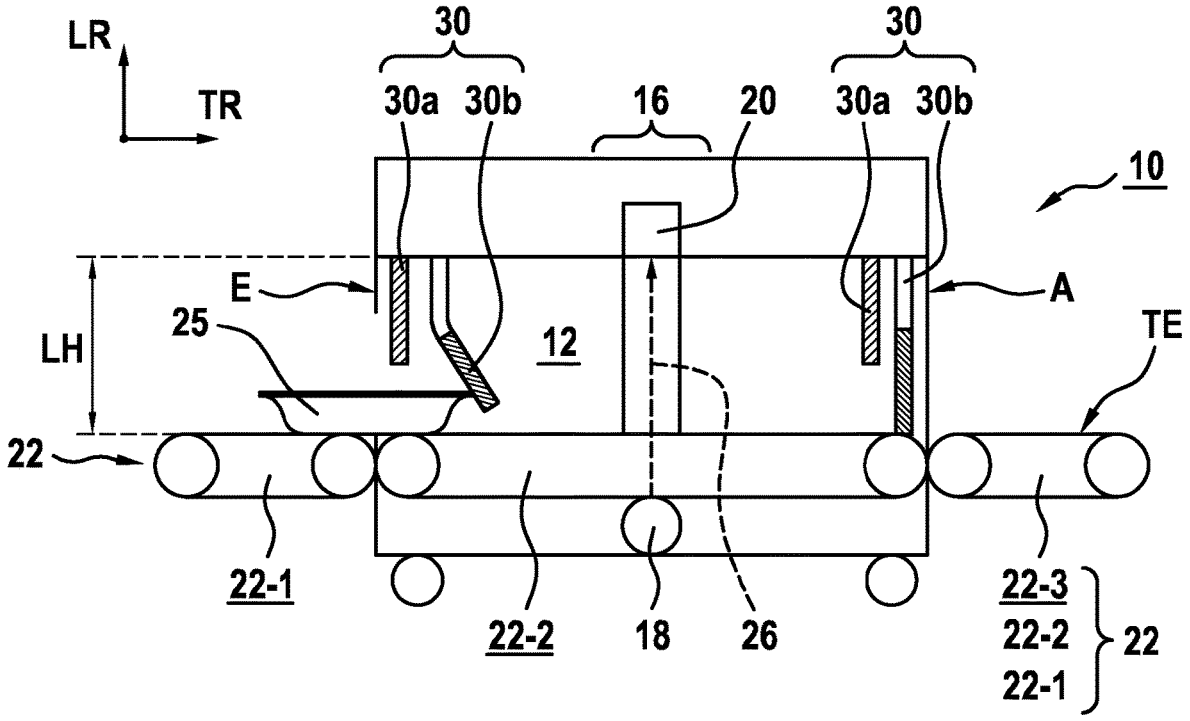
FIG. 4 shows a second use case of the example embodiment of the radiation protection device according to the disclosure of FIG. 3 in a lateral sectional view and an inspection object with a height such that the inspection object can be transported under the first radiation protection curtain.

The X-ray inspection apparatus 10 of FIGS. 3 and 4 can, for example, be used for the non-destructive inspection of baggage as inspection objects at an access to a security area at an airport. A radiation tunnel 12 of the inspection apparatus 10 is essentially an ionizing radiation shielding tube into which a transport system 22, consisting of individual partial transport units 22-1, 22-2, 22-3, for example belt conveyors, rope belt conveyors or similar, can introduce inspection objects 24, 25 at an opening E of a first open end in a transport direction TR into the radiation tunnel 12. The opening E at the first open end could serve both as entrance and exit of radiation tunnel 12, in which case the transport direction TR would have to be reversed in order to discharge the inspection object 24, 25.

Usually, and thus in the shown inspection apparatus 10, opening E at the first open end of radiation tunnel 12 serves as entrance to radiation tunnel 12 and a second opening A at a second open end serves as exit of radiation tunnel 12. In this configuration, inspection objects 24, 25 are conveyed through radiation tunnel 12 in transport direction TR, so that a continuous throughput at inspection apparatus 10 can be achieved.

The radiation tunnel 12 has a radiation section 16, in which the inspection objects 24, 25 are non-destructively X-rayed by means of ionizing radiation, in the example X-ray radiation. For this purpose, at least one radiation source 18, here an X-ray tube, as well as at least one detector arrangement 20 directed at the radiation emitted by the radiation source 18, here X-ray radiation, is arranged in radiation section 16.

The inspection apparatus 10 has a radiation protection device 30 at the entrance and at the exit of the radiation tunnel 12. The radiation protection device 30 consists of a first radiation protection curtain 30*a* and a second radiation protection curtain 30*b*. Between the two radiation protection curtains 30*a*, 30*b* there is the radiation area 16 with the at least one radiation source 18 and the detector arrangement 20 aligned to it.

Figure 1:
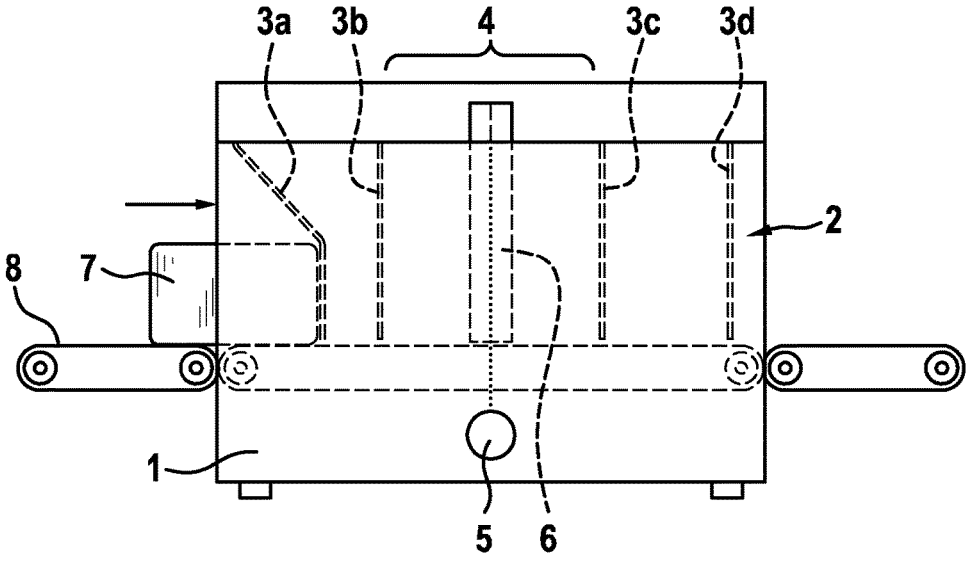
FIG. 1 shows a known X-ray inspection apparatus in a lateral sectional view with a radiation protection device consisting of several radiation protection elements.

The transport system 22, consisting of the three conveyor units 22-1, 22-2, 22-3, transports an inspection object 24, 25 through the radiation tunnel 12. The inspection object 24 in FIG. 1 is, for example, a suitcase. The inspection object 25 in FIG. 2 is, for example, a tray for smaller inspection objects (not shown), such as items of clothing or small appliances, such as a laptop. When passing through the radiation tunnel 12, the inspection objects 24, 25 are irradiated or shone through line by line by a radiation fan 26 generated by the radiation source 18 and the intensity of the radiation not absorbed by the inspection object 24, 25 is recorded as inspection data by means of the detector array 20.

In order to guarantee the reduction of the ionizing radiation emerging from the X-ray inspection apparatus 10 in accordance with the legal requirements, shielding sections of the radiation protection elements of the radiation protection curtains 30*a*, 30*b* each consist of a material suitable for shielding ionizing radiation, which has a thickness required for the desired shielding dimension (shielding factor).

In FIG. 3, the case as inspection object 24 stands on the transport level TE and has a height such that it does not fit under the first radiation protection curtain 30*a*. This means that the inspection object 24 must displace both the first radiation curtain 30*a* and the second radiation curtain 30*b* located behind it in the transport direction TR in order to be fed into the radiation tunnel 12 or discharged at the end.

FIG. 4 shows a second use case of the example embodiment of the radiation protection device of FIG. 3 according to the disclosure in a lateral sectional view and an inspection object with a height such that the inspection object can be transported under the first radiation protection curtain.

In FIG. 4, the tray as inspection object 25 stands on the transport level TE and has a height such that it fits under the first radiation protection curtain 30*a*. This means that the inspection object 25 does not have to displace the first radiation protection curtain 30*a*, but only the second radiation protection curtain 30*b* located behind it in the transport direction TR in order to be fed into radiation tunnel 12 or discharged at the end. Due to the fact that the second radiation protection curtain is considerably lighter than a single conventional radiation protection curtain that is dimensioned to cover the entire opening E, A at the entrance or at the exit of radiation tunnel 12, the small inspection object 25 can displace the second radiation protection curtain 30*b* more easily.

Thus, jams of smaller and often correspondingly lighter inspection objects at the radiation protection device 30 are avoided. Also, the alignment of smaller inspection objects on the transport system 22 is not changed, so that in inspection apparatuses in which different X-ray principles are used one after the other, an assignment of the inspection data is possible without any problems.

What is claimed is:

1. A radiation protection device for an opening for inspection objects on a radiation tunnel of an inspection apparatus, wherein the radiation protection device is formed from a plurality of radiation protection curtains arranged one behind the other at a distance in a transport direction of the radiation tunnel, wherein a first radiation protection curtain comprises a first shielding radiation protection curtain section covering only a first area of the opening, wherein second shielding radiation protection curtain sections of at least one second radiation protection curtain arranged behind the first radiation protection curtain in the transport direction cover the area of the opening not covered by the first radiation protection curtain, wherein a length of the first radiation protection curtain is shorter than a length of the at least one second radiation protection curtain, and wherein the first radiation protection curtain and the at least one second radiation protection curtain both extend from an upper edge of the opening such that a portion of the least one second radiation protection curtain overlaps with the first radiation protection curtain and the remainder of the at least one second radiation protection curtain extends down beyond a lower edge of the first radiation protection curtain.

2. The radiation protection device according to claim 1, wherein the first shielding radiation protection curtain section has a first length that corresponds to only a part of the clearance height of the opening.

3. The radiation protection device according to claim 1, wherein the shielding radiation protection curtain sections of two radiation protection curtains following each other in the transport direction through the radiation tunnel overlap in the longitudinal direction by an overlapping length with respect to the transport direction.

4. The radiation protection device according to claim 1, wherein two successive radiation protection curtains are arranged at a distance from one another in the transport direction through the radiation tunnel.

5. The radiation protection device according to claim 1, wherein the at least one second radiation protection curtain comprises at least the second shielding radiation protection curtain section and a non-shielding support section.

6. The radiation protection device according to claim 5, wherein the non-shielding support section is connected to the second shielding radiation protection curtain section by at least one of the following connection techniques from the group consisting of gluing, clamping, riveting, and sewing.

7. The radiation protection device according to claim 1, wherein in the first and/or second shielding radiation protection curtain section at least the core comprises a material with a high atomic number.

8. The radiation protection device according to claim 1, wherein at least one of the first and the at least one second radiation protection curtains is formed of individual radiation shielding elements each having a strip shape, and wherein a strip length is greater than a strip width and a strip thickness is substantially smaller than the strip width.

9. A radiation protection curtain for a radiation protection device, wherein the radiation protection curtain comprises a shielding section and a non-shielding support section that both extend along a longitudinal direction, the non-shielding support section dimensioned such that, when the radiation protection curtain is arranged on the radiation protection device as intended, the non-shielding support extends in the region of an opening to be covered by means of the radiation protection device and carries the shielding section, which in turn extends completely in the region of the opening to be covered by means of the radiation protection device.

10. The radiation protection curtain according to claim 9, wherein the support section is connected to the shielding section by at least one of the following joining techniques from the group consisting of gluing, clamping, riveting, and sewing.

11. The radiation protection curtain according to claim 9, wherein at least the core of the shielding section comprises a material with a high atomic number.

12. An inspection apparatus having at least one radiation protection device according to claim 1, wherein the radiation protection device is mounted at the opening of the radiation tunnel of the inspection apparatus, and the opening is an entrance of the radiation tunnel or an exit of the radiation tunnel.

13. The inspection apparatus according to claim 12, wherein radiation protection elements of the first radiation protection curtain are attached to the inspection apparatus at one end of the first shielding radiation protection curtain section by at least one joining technique from the group consisting of: screwing, clamping, and riveting.

14. The inspection apparatus according to claim 12, wherein radiation protection elements of the at least one second radiation protection curtain are attached at one end of the support section to the inspection apparatus by at least one joining technique from the group consisting of: screwing, clamping, and riveting.

15. A method for retrofitting a radiation protection device on an X-ray inspection apparatus, wherein an existing radiation protection device is replaced by a radiation protection device according to claim 1.

16. The radiation protection device according to claim 3, wherein the overlapping length of the overlap is greater than or equal to the distance between the successive radiation protection curtains.

17. The radiation protection device according to claim 4, wherein a minimum distance $D_{min}$ of the two successive radiation protection curtains is greater than or equal to $$D_{min}=\sqrt{2*L1*\Delta L-\Delta L^2},$$

where L1 is the total length of the shielding radiation protection curtain section of the preceding radiation protection curtain and ΔL is the length of an overlap of the radiation protection sections of the two successive radiation protection curtains.

18. The radiation protection device according to claim 4, wherein a maximum distance $D_{max}$ of two consecutive radiation protection curtains is less than or equal to $$D_{max}=(\Delta L*G)/(LH-L2),$$

where L2 is the length of the shielding radiation protection curtain section of the following radiation protection curtain, G is the distance of the following radiation protection curtain from a radiation plane of a radiation fan generated by a radiation generator, ΔL is the length of an overlap of the shielding radiation protection sections of the two successive radiation protection curtains, and LH is the clearance height of the opening of the radiation tunnel.

19. The radiation protection device according to claim 7, wherein the material with a high atomic number contains or consists of at least one of the following materials: pure lead, lead oxide, tin, tin oxide, lead vinyl, lead rubber, barium, samarium, tungsten, or a mixture of some or all of these materials.

20. The radiation protection element according to claim 9, wherein the material with a high atomic number comprises or consists of at least one of the following materials: pure lead, lead oxide, tin, tin oxide, lead vinyl, lead rubber, barium, samarium, tungsten, or a mixture of some or all of these materials.

* * * * *